US007125178B2

(12) United States Patent
Piccinino, Jr. et al.

(10) Patent No.: US 7,125,178 B2
(45) Date of Patent: Oct. 24, 2006

(54) PHOTOGRAPHIC PROCESSING ARRANGEMENT AND A PROCESSING SOLUTION SUPPLY CARTRIDGE FOR THE PROCESSING ARRANGEMENT

(75) Inventors: Ralph L. Piccinino, Jr., Rush, NY (US); John D. Manos, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 18 days.

(21) Appl. No.: 11/020,420

(22) Filed: Dec. 22, 2004

(65) Prior Publication Data

US 2006/0133801 A1 Jun. 22, 2006

(51) Int. Cl.
*G03D 3/02* (2006.01)

(52) U.S. Cl. ..... 396/626; 355/27

(58) Field of Classification Search ..... None
See application file for complete search history.

(56) References Cited

U.S. PATENT DOCUMENTS 5,532,780 A * 7/1996 Fyson ..... 396/630
6,017,687 A 1/2000 Darmon et al.
6,037,111 A 3/2000 Haye et al.
6,077,651 A 6/2000 Darmon et al.
6,136,518 A 10/2000 Buongiorne et al.
6,159,670 A 12/2000 Buongiorne et al.
6,228,567 B1 5/2001 Darmon et al.
6,403,290 B1 6/2002 Haye et al.
6,416,940 B1 7/2002 Haye et al.
7,014,373 B1 * 3/2006 Piccinino et al. ..... 396/626

* cited by examiner

*Primary Examiner*—D. Rutledge
(74) *Attorney, Agent, or Firm*—David A. Novais

(57) ABSTRACT

The present invention relates to a processing solution supply cartridge that utilizes a single developer solution holding area having interconnected compartments for a single-part developer concentrate. The holding area has interconnected compartments and includes valves that permit the cartridge to be utilized on an existing processor or processing machine. The design of the present invention assures a complete emptying of the cartridge by permitting the simultaneous replenishment of single-part developer through the valves into the processing machine.

14 Claims, 7 Drawing Sheets

PHOTOGRAPHIC PROCESSING ARRANGEMENT AND A PROCESSING SOLUTION SUPPLY CARTRIDGE FOR THE PROCESSING ARRANGEMENT

CROSS REFERENCE TO RELATED APPLICATIONS

The present application is related to U.S. patent application Ser. No. 10/722,249 filed Nov. 25, 2003, entitled PHOTOGRAPHIC PROCESSING ARRANGEMENT AND A PROCESSING SOLUTION SUPPLY CARTRIDGE FOR THE PROCESSING ARRANGEMENT

FIELD OF THE INVENTION

The present invention relates to a photographic processing arrangement for processing photographic material that includes a photographic processor and a photofinishing supply cartridge. The present invention further relates to a photofinishing solution supply cartridge that is adapted to be fluidly associated with a processor, and is further adapted to achieve a complete emptying of solutions from containers or compartments of the cartridge to facilitate handling of the empty cartridge.

BACKGROUND OF THE INVENTION

Conventional film and paper processing machines have difficulty in completely emptying the chemical cartridges associated with the machines. This is due to the highly coupled nature of the system since the processing machines are associated with a solution supply cartridge or arrangement that includes four independent containers that need to empty simultaneously. If a container of the cartridge contains significant retained chemistry following use, there is a possibility that the cartridge must be handled as hazardous waste.

FIG. 1 is a schematic illustration of one type of conventional solution cartridge 200. As shown in FIG. 1, solution cartridge 200 includes an outer container 2 that is adapted to hold four inner containers 4*a*, 4*b*, 4*c*, 4*d*. Each of containers 4*a*–4*d* is dedicated to a specific type of solution or chemical concentrate, for example, container 4*a* holds a first part of a color developer; container 4*b* holds a second part of a color developer; container 4*d* holds a stabilizer; and container 4*c* holds a third part of a color developer. Each of containers 4*a*–4*d* respectively includes valves or necks 6*a*, 6*b*, 6*c*, and 6*d* that extend from each of containers 4*a*–4*d* and pass through appropriate openings in outer container 2. In the arrangement of FIG. 1, it is preferable that the different parts of the color developer be held in separate containers (4*a*–4*c*) prior to being supplied to a processor or processing machine, since any mixture of the different parts of the developers prior to usage will degrade and adversely affect the properties of the developers.

In a conventional arrangement, cartridge 200 is adapted to be fluidly associated with a processor 10 which includes entry points or valves 12*a*, 12*b*, 12*d*, 12*c* that are adapted to be associated with each of valves or necks 6*a*, 6*b*, 6*d*, and 6*c*. Therefore this type of cartridge package as noted above has four necks or valves 6*a*, 6*b*, 6*d* and 6*c* that associate with four corresponding valves or entry points 12*a*, 12*b*, 12*d* and 12*c* of processing machine 10. The full/empty state of cartridge 200 is sensed by the presence or absence of float, indicated by reference numerals 14*a*, 14*b*, 14*d* and 14*c* in FIG. 1, which are associated with each of valves 6*a*, 6*b*, 6*d* and 6*c*. In one embodiment, an infrared beam can pass through valves 6*a*–6*d* of the cartridge 200 to detect the presence or absence of a float 14*a*–14*d* to determine the full/empty state of the individual container 4*a*, 4*b*, 4*c* and 4*d*. As further described above, four chemical concentrates are contained in four separate containers 4*a*–4*d* housed in a common outer container 2.

A drawback with the arrangement noted above is that during use of cartridge 200, developer or chemical concentrate exiting from each container 4*a*, 4*b*, and 4*c* through respective valves 6*a*, 6*b* and 6*c* is constantly metered and observed so as to assure that each of containers 4*a*–4*c* empty together. If they do not empty together as noted above, then at least one of the containers will include residual chemistry following use, which leads to the characterization of the handling of the container as hazardous waste. A further drawback with conventional arrangements such as the arrangement shown in FIG. 1 is that the individual containers in some instances are held in a clamshell type arrangement. The use of a clamshell may reduce the available volume for liquid in the cartridge.

SUMMARY OF THE INVENTION

The present invention provides for an improved photofinishing solution supply cartridge for a photographic processing arrangement, wherein its emptying is controlled by only one chemical cartridge, to thereby guarantee that the cartridge can be disposed of as non-hazardous waste. Additionally, the chemical solution supply cartridge of the present invention is adapted to process more prints since the emptying of the compartments that include the developer can be more accurately controlled.

In a feature of the present invention, a single holding area defined by fluidly connected compartments is used due to the utilization of a single-part developer concentrate in the container. U.S. Pat. Nos. 6,017,687; 6,037,111; 6,077,651; 6,136,518; 6,159,670; 6,228,567; 6,403,290; and 6,416,940 the contents of which are herein incorporated by reference, teach a single-part color developing concentrate and a method of making the single-part color developing concentrate, which is used in the photofinishing solution supply cartridge and arrangement of the present invention.

In the present invention, the current three-part developer concentrate as illustrated in FIG. 1 is replaced by a single-part developer concentrate as described in the above patents. Further, the three developer concentrate containers are replaced by a single holding area. This single holding area can be simultaneously emptied through valves associated with connected compartments of the holding area. By utilizing a holding area with a single-part developer as discussed above, it is possible to simultaneously supply processing solution through the valves of the cartridge. Because of the use of a single holding area, the complete emptying of the holding area is assured so as to minimize any hazardous material remaining in the cartridge.

In a feature of the present invention, the stabilizer compartment is located in the cartridge in a position that is analogous to the position of the stabilizer container or compartment in the conventional arrangement. Therefore, the cartridge in accordance with the present invention can be used in existing processors where the stabilizer entrance is located at 12*d* as shown in FIG. 1. In order to permit this arrangement, the present invention provides for a developer solution holding area that holds a single part developer, has fluidly connected compartments located on opposing sides of the stabilizer solution compartment, and includes at least one welded connecting chamber or path that bypasses the stabilizer solution compartment and fluidly connects the developer compartments.

The present invention therefore relates to a photofinishing solution supply cartridge that comprises a stabilizer solution compartment comprising a stabilizer solution valve for fluid communication with a photographic processor; and a developer solution holding area adapted to hold a single-part developer therein. The developer solution holding area comprises a first compartment located on a first side of the stabilizer solution compartment, a second compartment located on a second side of the stabilizer solution compartment, and at least one connecting chamber or path that bypasses the stabilizer solution compartment and fluidly connects the first compartment and the second compartment.

DETAILED DESCRIPTION OF THE INVENTION

Figure 2:
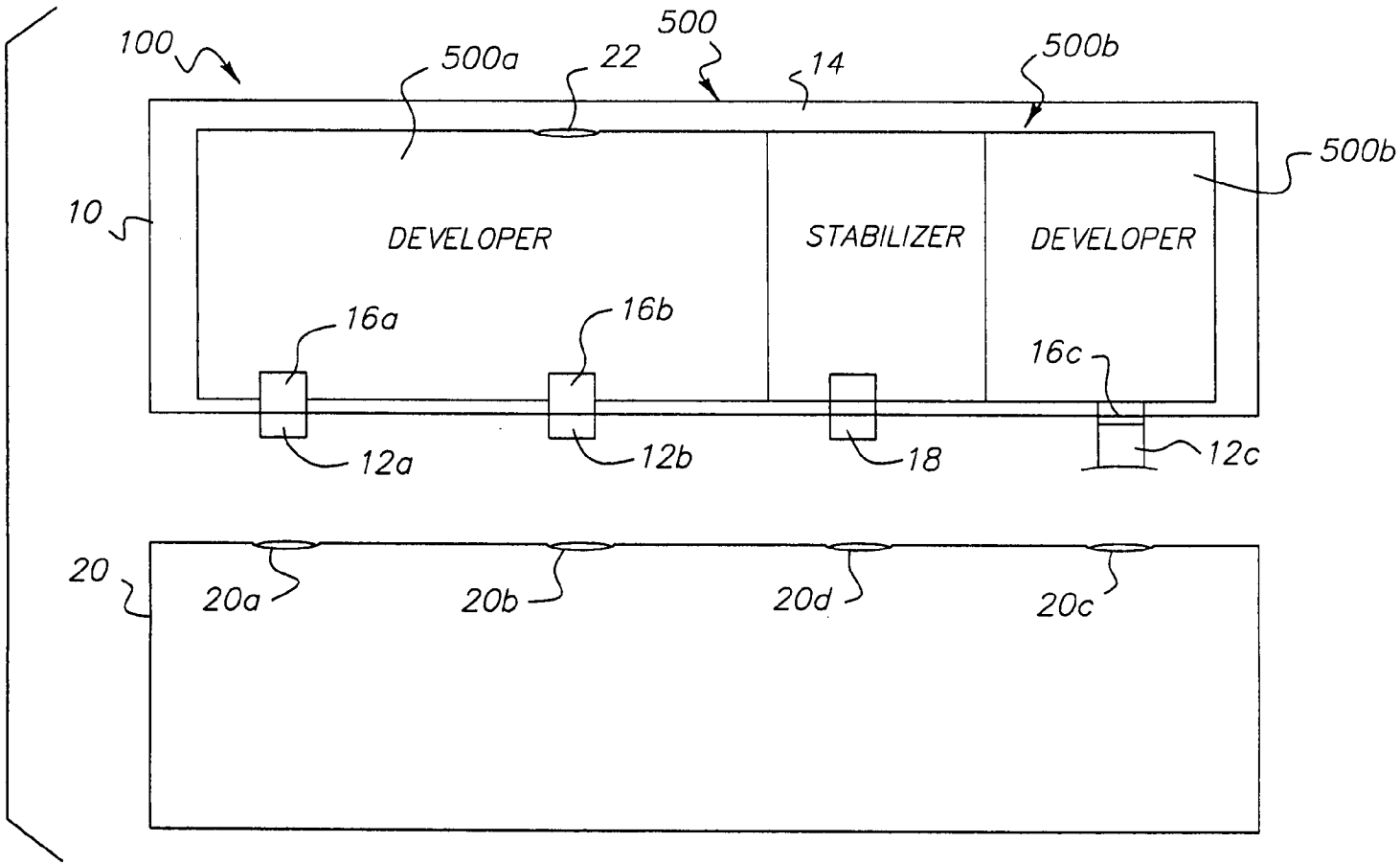
FIG. 2 is a schematic view of a solution supply cartridge in accordance with the present invention, wherein the cartridge is adapted to be fluidly associated with a photographic processor.

Referring now to the drawings, wherein like reference numerals represent corresponding or identical parts throughout the several views, FIG. 2 illustrates a cartridge or assembly in accordance with a first feature of the present invention. As illustrated in FIG. 2, a processing solution supply cartridge 100 includes an outer container 10 which has positioned therein a single part developer holding area 500 that includes a first compartment 500*a* and a second compartment 500*b*. Holding area 500 is adapted to hold a single-part developer concentrate as described in, for example, U.S. Pat. No. 6,017,687 and the other patents cited to show single-part developers. Also provided within outer container 10 is an inner container or compartment 14 used for holding stabilizer solution therein.

Compartment 500*a* of holding area 500 includes valves 12*a* and 12*b* that are adapted to provide fluid communication with a photographic processor 20 through openings 20*a*, 20*b*. Compartment 500*b* of holding area 500 includes a valve 12*c* that is adapted to provide fluid communication with processor 20 through opening 20*c*. Each valve 12*a*, 12*b* and 12*c* respectively includes a float 16*a*, 16*b* and 16*c* therein. Stabilizer container or compartment 14 includes a valve 18 for fluid communication with processor 20 through opening 20*d*. Floats 16*a*, 16*b* and 16*c* within valves 12*a*, 12*b* and 12*c* can be adapted to provide a signal to a controller or to an operator to signal the empty/full state of compartments 500*a* and 500*b* of holding area 500. As an example, an infrared beam can be directed to the valves to detect the presence or absence of the floats. Valve 18 for stabilizer container or compartment 14 may or may not include a float therein. If valve 18 of compartment 14 does not include a float therein, compartments 500*a* and 500*b* of holding area 500 can empty to signal that cartridge 100 requires replacement. In this case, if stabilizer container or compartment 14 empties prematurely, water can be the sole source of replenishment for the stabilizer tank until the cartridge is replaced. On the other hand, if valve 18 for stabilizer compartment 14 includes a float therein, a user can overfill the stabilizer compartment 14 to assure that the developer in holding area 500 empties first.

Figure 3:
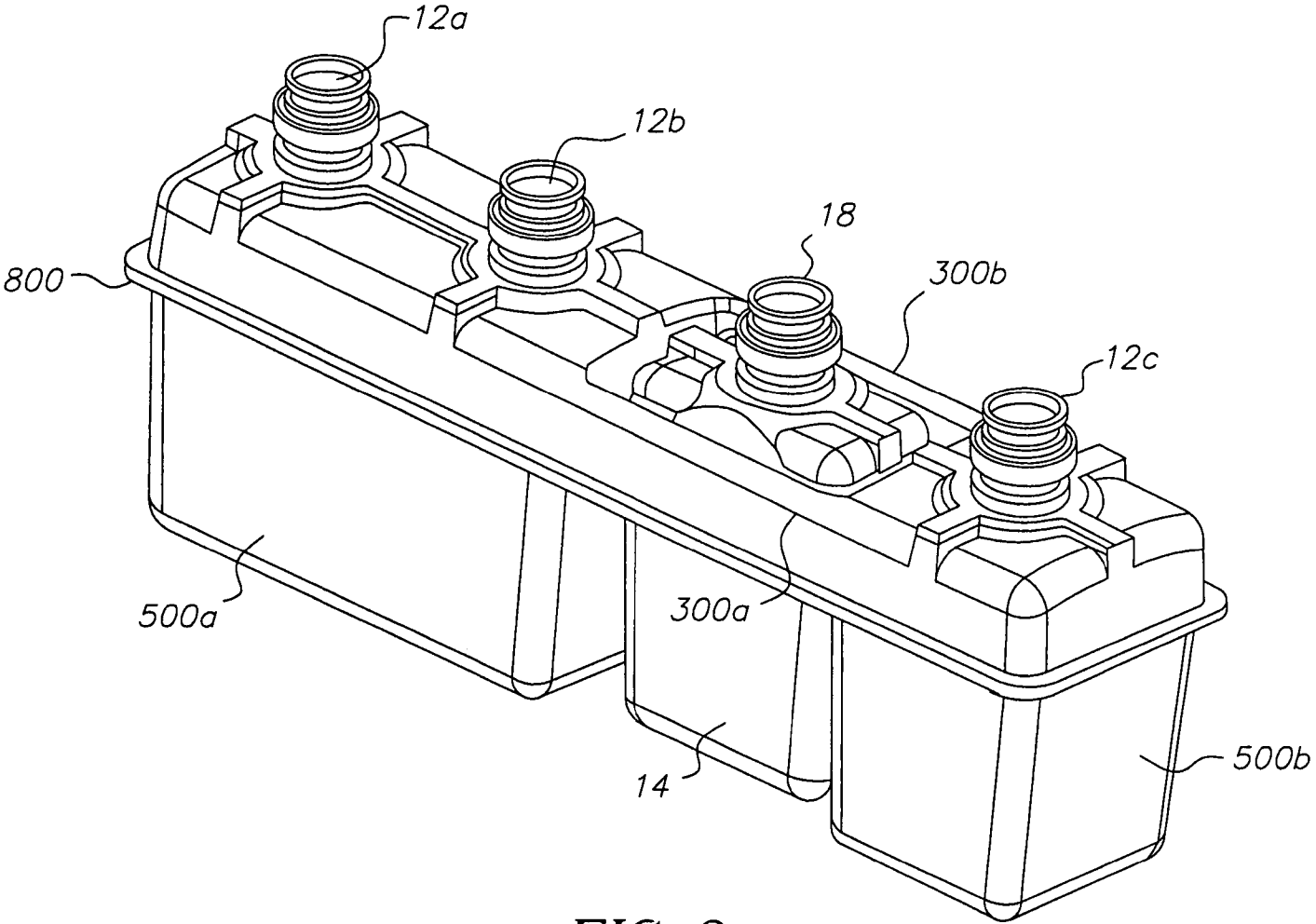
FIG. 3 is a perspective view of the compartments of the cartridge in accordance with the present invention.

As shown in FIG. 3 connecting chambers or paths 300*a* and 300*b* are provided to fluidly connect compartments 500*a* and 500*b*. In the perspective view of FIG. 3, the outer container 10 is not illustrated to facilitate the understanding of this feature of the invention. It is noted that connecting chambers 300*a* and 300*b* are adapted to bypass stabilizer solution compartment 14 while fluidly connecting compartment 500*a* with compartment 500*b*.

Cartridge 100 is adapted to be fluidly associated, as noted above, with photographic processor 20 for processing photographic material. That is, photographic processor 20 is of the type that processes photographic material by passing or conveying the photographic material through distinct photochemical solutions for processing the photographic materials. Processor 20 can be an existing processor that includes corresponding valves or openings 20*a*, 20*b*, 20*c* and 20*d* that are aligned with the valves of a traditional solution cartridge as illustrated in FIG. 1.

Figure 1:
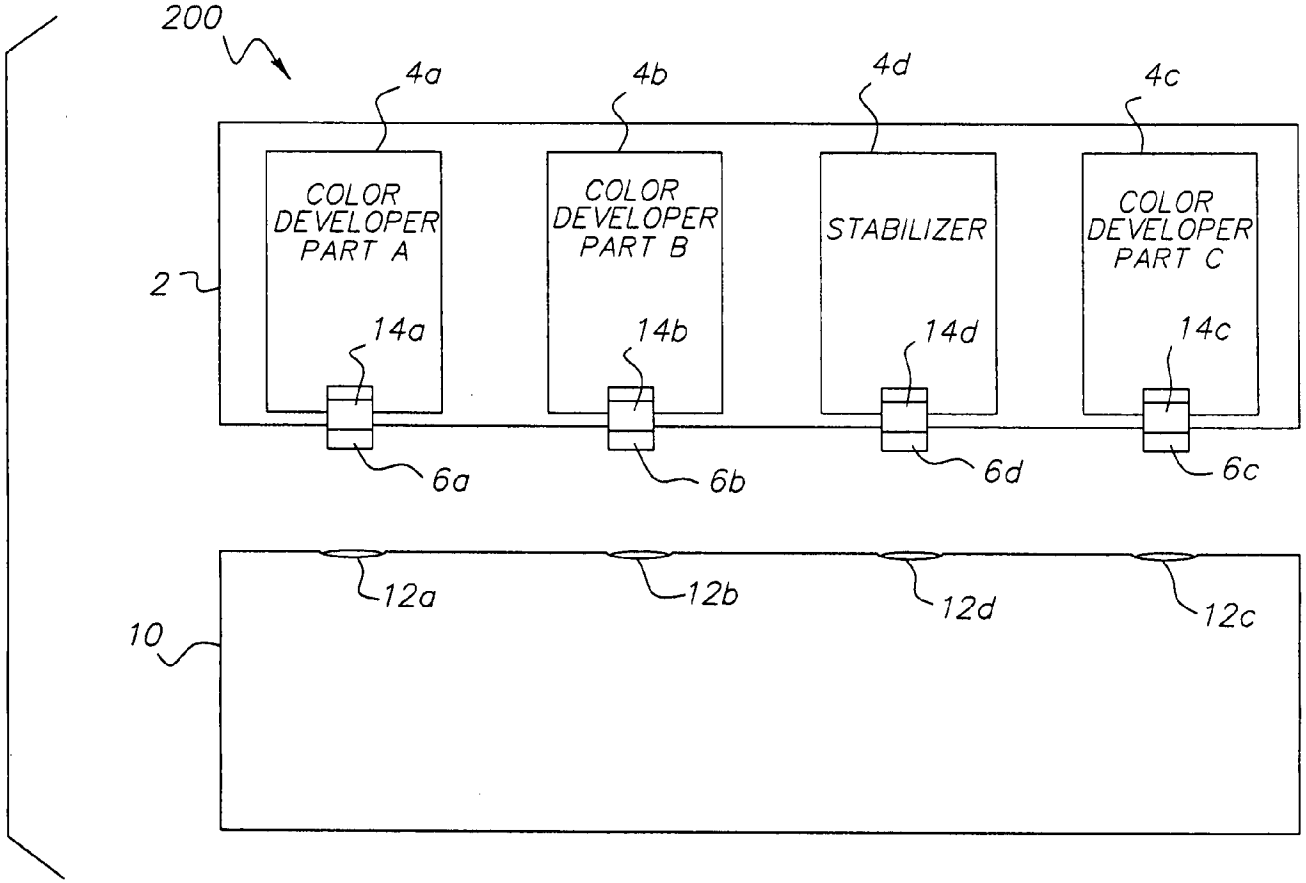
FIG. 1 (PRIOR ART)
FIG. 1 is a schematic illustration of a conventional solution supply cartridge associated with a known photographic processor.

With the conventional arrangement of FIG. 1, where traditional developers are used, the different parts of the developers need to be stored in separate containers due to the fact that the mixing of the different developer parts during storage or while in the chemical supply cartridge adversely affects the properties of the developer. With a single-part developer as shown and described in the cited patents, it is not necessary to separate the developer parts and therefore, a solution supply cartridge 100 as shown in FIG. 2 which includes a single holding area 500 having fluidly connected compartments 500*a* and 500*b* can be utilized. The advantage of using the single developer holding area 500 as noted above is that during a processing cycle, the single-part developer can be replenished into processor 20 by simultaneously supplying the single-part developer through valves 12*a*, 12*b* and 12*c* into processor 20. This assures that all of the developer within compartments 500*a* and 500*b* of holding area 500 empties into processor 20. Also, with the developer being simultaneously supplied through valves 12*a*, 12*b* and 12*c*, it is assured that no developer remains in the holding area 500, and it is not necessary to meter the amount of color developer coming from distinct developer containers. Therefore, no hazardous developer will remain in the container after the appropriate amount of processing cycles has been achieved.

A further advantage of a solution supply cartridge with a single holding area having connected compartments as noted above is that the cartridge can be fluidly associated with the valves of a traditional processor which has three to four valves, by fluidly associating valves 12*a*, 12*b* and 12*c* with the existing valves 20*a*, 20*b* and 20*c* on processor 20. Thus, cartridge 100 can be utilized on existing processing machines.

Further, by having floats 16*a*, 16*b* and 16*c* in valves 12*a*, 12*b* and 12*c*, a signal can be sent when all the developer solution is emptied from holding area 500 to automatically alert an operator that the supply cartridge needs to be replaced.

In a further feature of the present invention, holding area 500 having fluidly connected compartments 500*a* and 500*b* can be reusable by providing for an opening 22 (FIG. 2) in holding area 500. Therefore, after all of the single-part developer has been emptied from holding area 500, a user can simply refill compartments 500*a* and 500*b* of holding area 500 with new single-part developer concentrate through opening 22, without having to remove cartridge 100 from processor 20.

Figure 4:
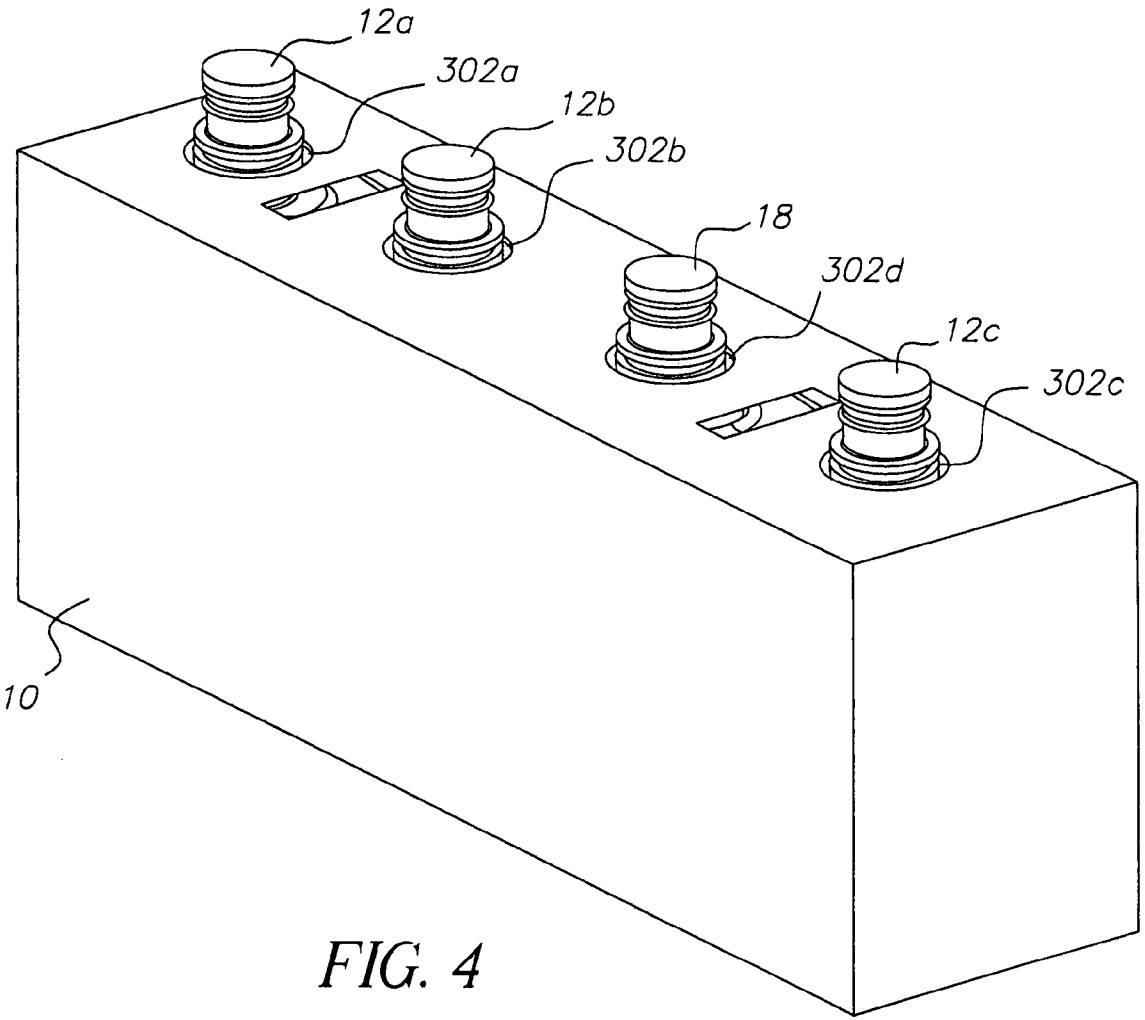
FIG. 4 is a view of a container, wherein the compartments in accordance with the present invention are placed in the container.

FIG. 4 shows compartments 500*a* and 500*b* as well as compartment 14 located within outer container 10. As shown in FIG. 4, outer container 10 has openings 302*a*, 302*b*, 302*d* and 302*c*, respectively aligned with valves 12*a*, 12*b*, 18 and 12*c*, to permit the passage of the valves therethrough.

Therefore, as shown in FIG. 3, photofinishing solution supply cartridge 100 comprises stabilizer solution compartment 14 that comprises a stabilizer solution valve 18 for fluid communication with a photographic processor. The cartridge 100 further includes developer solution holding area 500 adapted to hold a single-part developer therein. The developer solution holding area 500 comprises first compartment 500*a* located on a first side of the stabilizer solution compartment 14, second compartment 500*b* located on a second side of stabilizer solution compartment 14, and at least one and preferably two connecting chambers or paths 300*a* and 300*b* that bypass the stabilizer solution compartment 14 and fluidly connect the first compartment 500*a* and the second compartment 500*b*.

The first compartment 500*a* comprises a first valve 12*a* and a second valve 12*b*, the second compartment 500*b* comprises a third valve 12*c*, and the compartment 14 comprises a valve 18. Each of the valves 12*a*, 12*b*, 12*c* and 18 are adapted to be fluidly connected to the photographic processor. Also, each of the valves 12*a*, 12*b* and 12*c* comprises a float 16*a*, 16*b* and 16*c* therein, while valve 18 of the stabilizer solution compartment 14 does not contain a float.

With the arrangement of the present invention, during a processing cycle, first compartment 500*a* and second compartment 500*b* are adapted to supply a single-part developer to the photographic processor simultaneously through the valves 12*a*, 12*b* and 12*c*.

In a feature of the invention, each of the first and second compartments 500*a* and 500*b* and the stabilizer solution compartment 14 are located within outer container 10 as shown in FIG. 4.

Figure 5:
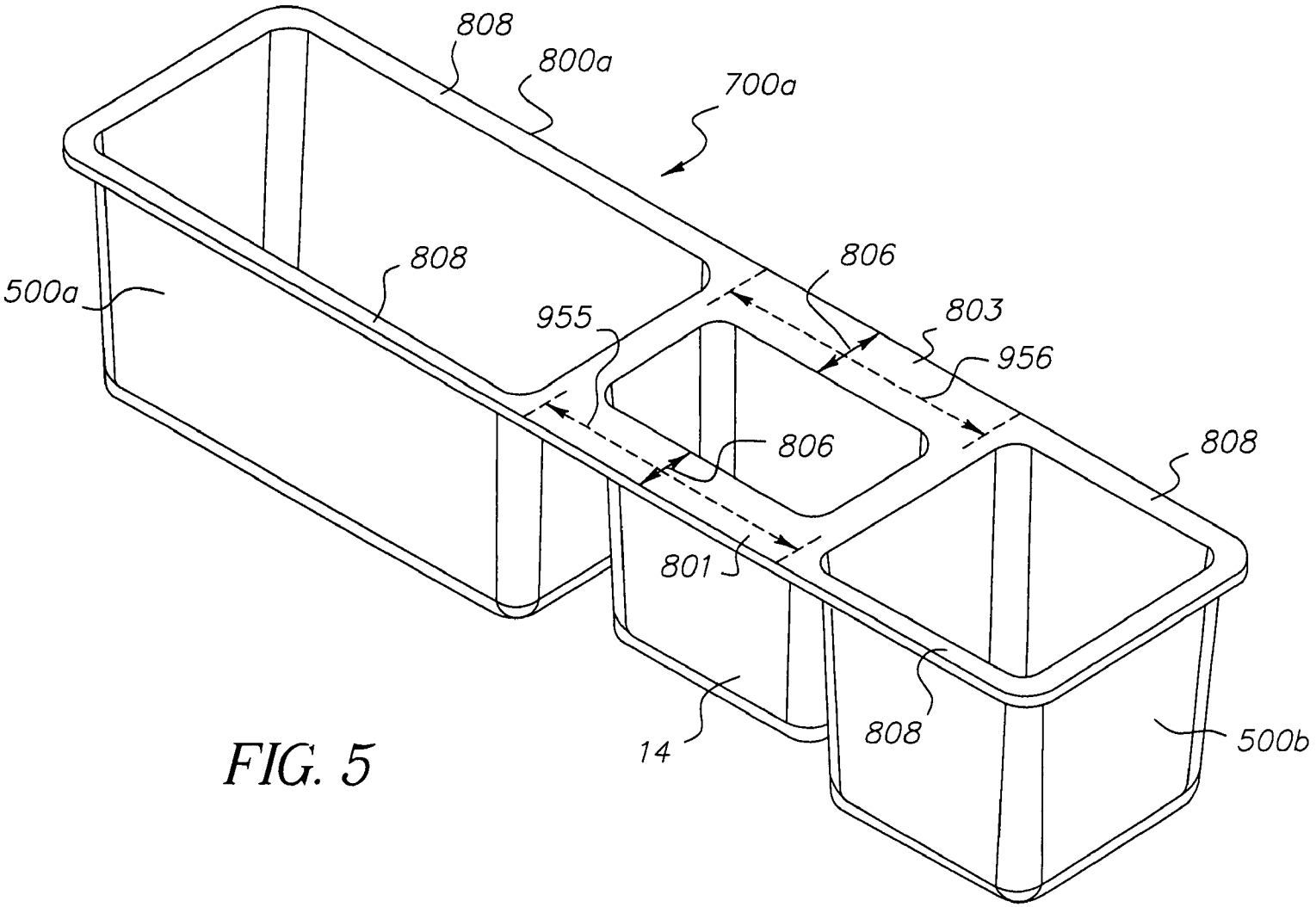
FIG. 5 is a perspective view of a first part of the compartments of FIG. 3.
Figure 6:
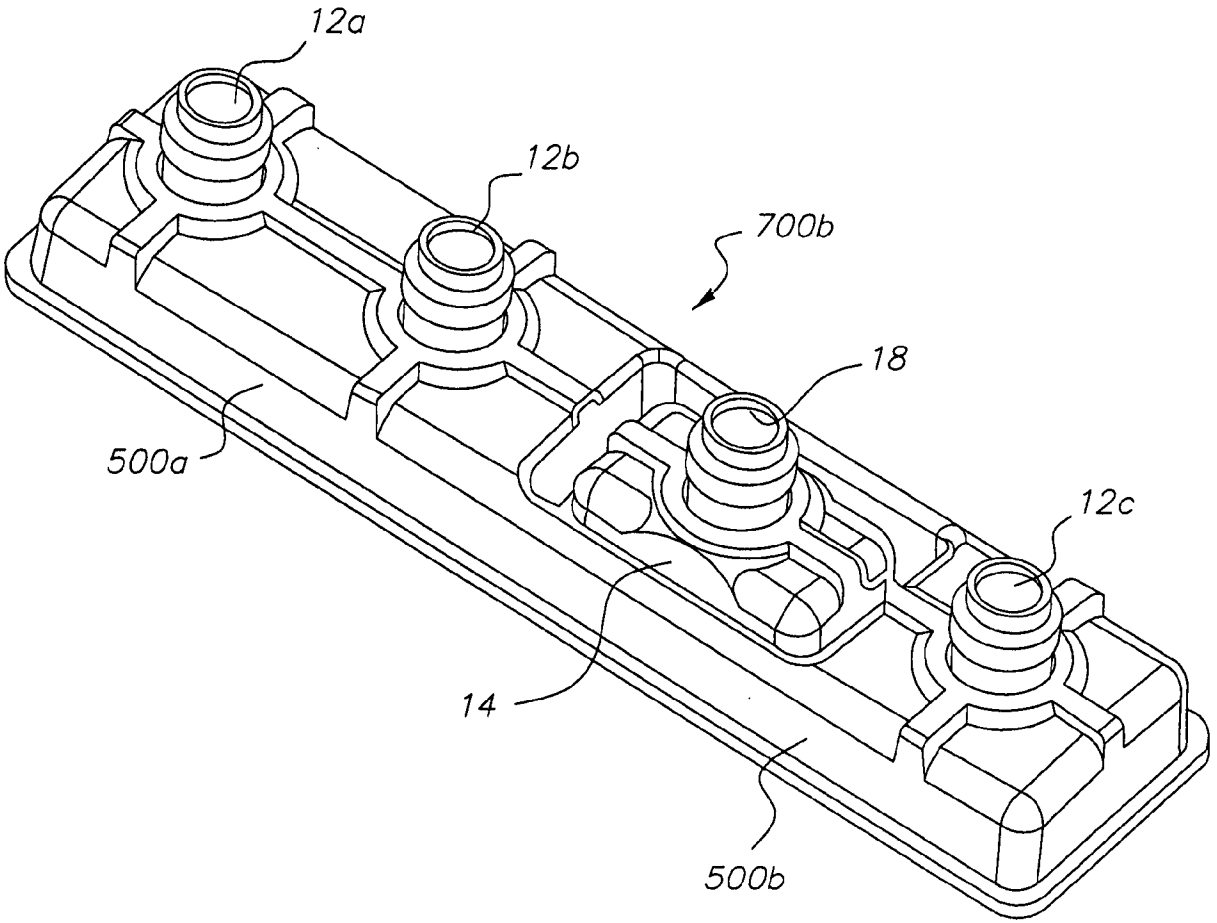
FIG. 6 is a view of a second part of the compartments of FIG. 3.
Figure 7:
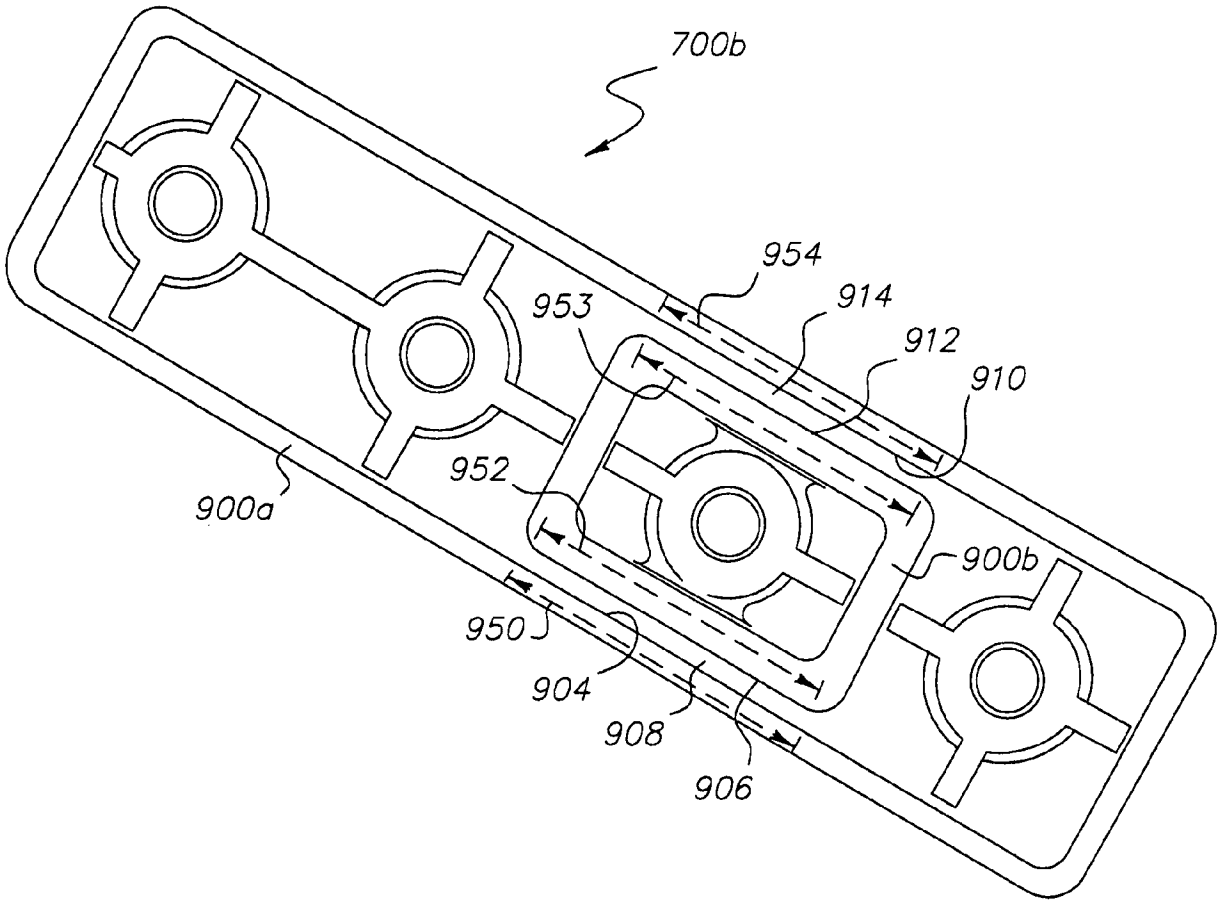
FIG. 7 is a bottom view of the second part of the compartments of FIG. 6.

Reference is now made to FIGS. 5, 6 and 7 where the arrangement in accordance with the present invention is illustrated in separate sections to facilitate understanding of the invention. In a further feature of the present invention, each of the first compartment 500*a*, the stabilizer solution compartment 14 and the second compartment 500*b* are formed by a first integral part 700*a* (FIG. 5) that includes a substantial portion of the first compartment 500*a*, a substantial portion of the stabilizer solution compartment 14, and a substantial portion of the second compartment 500*b*; and a second integral part 700*b* (FIGS. 6 and 7) that includes a remaining portion of the first compartment 500*a*, a remaining portion of the stabilizer solution compartment 14 and a remaining portion of the second compartment 500*b*. It is noted that a boundary between first integral part 700*a* and second integral part 700*b* is illustrated by reference numeral 800 in FIG. 3. In the views of FIGS. 5, 6 and 7, the cartridge is shown as being split at boundary 800 such that FIG. 5 illustrates a top view of the first integral part 700*a*, FIG. 6 illustrates a top view of the second integral part 700*b*, and FIG. 7 illustrates a bottom view of second integral part 700*b*.

As shown in FIGS. 3 and 6, the second integral part 700*b* comprises valves 12*a* and 12*b* that are associated with first compartment 500*a*, valve 12*c* associated with the second compartment 500*b*, and valve 18 associated with the stabilizer solution compartment 14.

As shown in FIG. 5, first integral part 700*a* comprises a first mating surface 800*a* at boundary 800, such that a first section 801 of the first mating surface 800*a* in an area of the stabilizer solution compartment 14, and a second section 803 of the first mating surface 800*a* in the area of the stabilizer solution compartment 14 each have a width 806 that is wider than the width of the remaining sections 808 of the first mating surface 800*a*.

As shown in FIG. 7, the second integral part 700*b* comprises a second mating surface 900*a* and a third mating surface 900*b* that are located in the vicinity of boundary 800. The second mating surface 900*a* extends around a periphery of the second integral part 700*b* and substantially corresponds to the first mating surface 800*a* of the first integral part 700*a*, and the third mating surface 900*b* is located within the second mating surface 900*a* and extends around a periphery of an area defined by the stabilizer solution compartment 14.

In a feature of the present invention, the first integral part 700*a* and the second integral part 700*b* are attached to each other at boundary 800 such that the connecting part or path 300*a* is defined by the first section 801 of the first mating surface 800*a*, a first wall 904 associated with second mating surface 900*a* which corresponds to the first section 801 of said first mating surface 800*a*, a second wall 906 associated with the third mating surface 900*b* that opposes the first wall 904 of the second mating surface 900*a* and corresponds to the first section 801 of the first mating surface 800*a*, and a surface 908 on second integral part 700*b* that opposes first section 801. Analogous to connecting part or path 300*a*, connecting part or path 300*b* is defined by second section 803, a wall 910 associated with mating surface 900*a*, a wall 912 associated with mating surface 900*b*, and a surface 914 that opposes second section 803.

Each of connecting chambers or paths 300*a* and 300*b* defined as noted above, provide for the fluid connection of compartments 500*a* and 500*b* while bypassing stabilizer compartment 14. This assures that a single part developer can be used and that the single part developer simultaneously empties through valves 12*a*, 12*b* and 12*c* when cartridge 100 is associated with processor 20. In order to facilitated the manufacture of the cartridge and assure that the paths 300*a* and 300*b* are fluid tight and do not permit any leakage of developer solution either into stabilizer compartment 14 or outside of the cartridge, in a preferred feature of the present invention the paths 300*a* and 300*b* include a welded section or sections. More specifically, the invention provides for the inclusion of a weld along areas 950, 952, 953 and 954 of second integral part 700*b* or a weld along areas 955 and 956 of first integral part 700*a*, at areas that correspond to paths 300*a* and 300*b* so as to form paths 300*a* and 300*b* in a non-leak type manner.

Therefore, the present invention provides for a cartridge where the complete emptying of a single-part developer solution into a processor is controlled by a single developer holding area having interconnected compartments, thereby guaranteeing that the cartridge can be disposed of as non-hazardous waste. The cartridge of the present invention utilizes a single-part developer concentrate that is simultaneously replenished into a processing machine through valves to assure the complete emptying of the developer container. The choice of valves utilized in the cartridge of the present invention can be based on necessary replenishment rates required by existing processors in the field, or by rates required by new processors specifically designed for the cartridge of the present invention. The stabilizer solution can be delivered from its location analogous to the conventional package as described above. The stabilizer valve or neck of the present invention does not have a float in it to ensure that the developer container empties to signal that the package requires replacing. If the stabilizer position empties prematurely, water can be the sole source of replenishment until the package is replaced.

The complete emptying of the developer container of the present invention results in increase customer satisfaction and easier disposal of spent cartridges. Further, the increased capacity of the containers of the present invention results in lower customer inventory space required and fewer cartridge changes per unit time.

The invention has been described in detail with particular reference to certain preferred embodiments thereof, but it will be understood that variations and modifications can be effected within the spirit and scope of the invention.

The invention claimed is:

1. A photofinishing solution supply cartridge comprising:

a stabilizer solution compartment comprising a stabilizer solution valve for fluid communication with a photographic processor; and a developer solution holding area adapted to hold a single-part developer therein, said developer solution holding area comprising a first compartment located on a first side of said stabilizer solution compartment, a second compartment located on a second side of said stabilizer solution compartment, and at least one connecting chamber that bypasses said stabilizer solution compartment and fluidly connects said first compartment and said second compartment.

2. A photofinishing solution supply cartridge according to claim 1, wherein said first compartment comprises a first valve and said second compartment comprises a second valve, each of said first valve and said second valve being adapted to be fluidly connected to the photographic processor.

3. A photofinishing solution supply cartridge according to claim 1, wherein said first compartment comprises a first valve and a second valve, and said second compartment comprises a third valve, each of said first, second and third valves being adapted to be fluidly connected to the photographic processor.

4. A photofinishing solution supply cartridge according to claim 2, wherein each of said first and second valves comprises a float therein and said stabilizer solution solution valve does not contain a float.

5. A photofinishing solution supply cartridge according to claim 3, wherein each of said first, second and third valves comprises a float therein and said stabilizer solution valve does not contain a float.

6. A photofinishing solution supply cartridge according to claim 3, wherein during a processing cycle, said first compartment and said second compartment are adapted to supply said single-part developer to the photographic processor simultaneously through said first, second and third valves.

7. A photofinishing solution supply cartridge according to claim 1, further comprising a second connecting chamber that bypasses said stabilizer solution compartment and fluidly connects said first compartment and said second compartment.

8. A photofinishing solution supply cartridge according to claim 1, further comprising an outer container, each of said first and second compartments and said stabilizer solution compartment being located within said outer container.

9. A photofinishing solution supply cartridge according to claim 1, wherein each of said first compartment, said stabilizer solution compartment and said second compartment are formed by:

a first integral part that includes a substantial portion of said first compartment, a substantial portion of said stabilizer solution compartment and a substantial portion of said second compartment; and a second integral part that includes a remaining portion of said first compartment, a remaining portion of said stabilizer solution compartment and a remaining portion of said second compartment.

10. A photofinishing solution supply cartridge according to claim 9, wherein said second integral part comprises a first valve and a second valve associated with said first compartment, a third valve associated with said second compartment, and a fourth valve associated with said stabilizer solution compartment, each of said first, second, third and fourth valves being adapted to be fluidly connected to the photographic processor.

11. A photofinishing solution supply cartridge according to claim 9, wherein:

said first integral part comprises a first mating surface, wherein a first section of said first mating surface in an area of said stabilizer solution compartment, and a second section of said first mating surface in the area of said stabilizer solution compartment have a width which is wider than the remaining sections of said first mating surface.

12. A photofinising solution supply cartridge according to claim 11, wherein:

said second integral part comprises a second mating surface and a third mating surface, said second mating surface extending around a periphery of said second integral part and substantially corresponding to said first mating surface of said first integral part, and said third mating surface being located within said second mating surface and extending around a periphery of said stabilizer solution compartment.

13. A photofinishing solution supply cartridge according to claim 12, wherein said first integral part and said second integral part are attached to each other such that said at least one connecting chamber is defined by at least said first section of said first mating surface, a first wall of said second mating surface which corresponds to said first section of said first mating surface, and a second wall of said third mating surface which opposes said first wall of said second mating surface and corresponds to first section of said first mating surface.

14. A photofinishing solution supply cartridge according to claim 13, wherein said first and second integral parts include a weld at least in an area corresponding to said at least one connecting chamber.

* * * * *